US008701357B2

(12) United States Patent
Kovel

(10) Patent No.: US 8,701,357 B2
(45) Date of Patent: Apr. 22, 2014

(54) MODULAR CONSTRUCTION SYSTEMS AND METHODS

(76) Inventor: Jeffrey Kovel, Portland, OR (US)

( * ) Notice: Subject to any disclaimer, the term of this patent is extended or adjusted under 35 U.S.C. 154(b) by 297 days.

(21) Appl. No.: 13/015,427

(22) Filed: Jan. 27, 2011

(65) Prior Publication Data

US 2011/0185646 A1 Aug. 4, 2011

Related U.S. Application Data

(60) Provisional application No. 61/301,130, filed on Feb. 3, 2010.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 12/00*** | (2006.01) |

(52) U.S. Cl.
USPC ..... 52/79.4; 52/653.1; 52/236.1; 52/236.4; 52/DIG. 10

(58) Field of Classification Search
USPC ..... 52/79.1–79.4, 79.6–79.9, 79.12, 234, 52/236.1, 236.3, 236.4, 236.6, 270, 637, 52/648.1, 652.1, 653.1, 745.02, 745.03, 52/745.2, 745.13, DIG. 10
See application file for complete search history.

(56) References Cited

U.S. PATENT DOCUMENTS

| | | | | |
|---|---|---|---|---|
| 3,372,518 | A * | 3/1968 | Rensch Eberhard G | 52/223.7 |
| 3,645,052 | A | 2/1972 | Hanna | |
| 3,769,766 | A * | 11/1973 | Speidel | 52/73 |
| 3,818,654 | A * | 6/1974 | Schramm | 52/79.7 |
| 3,964,216 | A * | 6/1976 | Hummel | 52/79.1 |
| 4,295,307 | A * | 10/1981 | Jensen | 52/236.1 |
| 4,633,641 | A * | 1/1987 | Heinbuchner | 52/745.03 |
| 5,031,371 | A * | 7/1991 | Davister | 52/236.1 |
| 5,235,787 | A * | 8/1993 | Bloxsom et al. | 52/79.3 |
| 5,671,579 | A * | 9/1997 | Miranda Camino et al. | 52/653.1 |
| 5,884,437 | A | 3/1999 | Olsen | |
| 6,173,538 | B1 * | 1/2001 | Fleishman | 52/81.4 |
| 6,748,704 | B2 * | 6/2004 | Eguchi et al. | 52/79.1 |
| 7,658,039 | B2 * | 2/2010 | Ziegelman | 52/79.1 |
| 8,256,168 | B2 * | 9/2012 | Bigger | 52/79.2 |
| 2002/0046518 | A1 * | 4/2002 | Eguchi et al. | 52/220.1 |
| 2005/0144857 | A1 | 7/2005 | Guerrero | |
| 2009/0049760 | A1 * | 2/2009 | Stuck | 52/79.1 |
| 2010/0132284 | A1 * | 6/2010 | Takeshima | 52/236.1 |
| 2010/0218435 | A1 * | 9/2010 | Reeves | 52/79.1 |
| 2011/0167752 | A1 * | 7/2011 | Daadoush | 52/653.1 |
| 2011/0173899 | A1 * | 7/2011 | Lythgoe | 52/79.4 |
| 2012/0291365 | A1 * | 11/2012 | Rodriguez | 52/79.9 |

* cited by examiner

*Primary Examiner* — Ryan Kwiecincki
(74) *Attorney, Agent, or Firm* — Ganz Law, P.C.

(57) ABSTRACT

In certain embodiments, the inventive subject matter is directed to modular subunit based on a has a frame having three equal length structural segments joined at each end to form a triangular shape, and wherein the structural segments form a bounded section. The bounded section may be a load bearing structure. The bounded section may include three trapezoidal elements arranged to form a triangle. The bounded section may include one of the following: SIP, flooring system, a ceiling system, a roofing system, glass, drop panels, empty. A modular unit may be formed having two of the triangular frames separated by a perpendicular column at each corner to form a normal right pentahedral shape; and wherein the triangular frame further comprising three equal length structural segments joined at each end forming a triangular shape; wherein the structural segments form a bounded section.

23 Claims, 19 Drawing Sheets

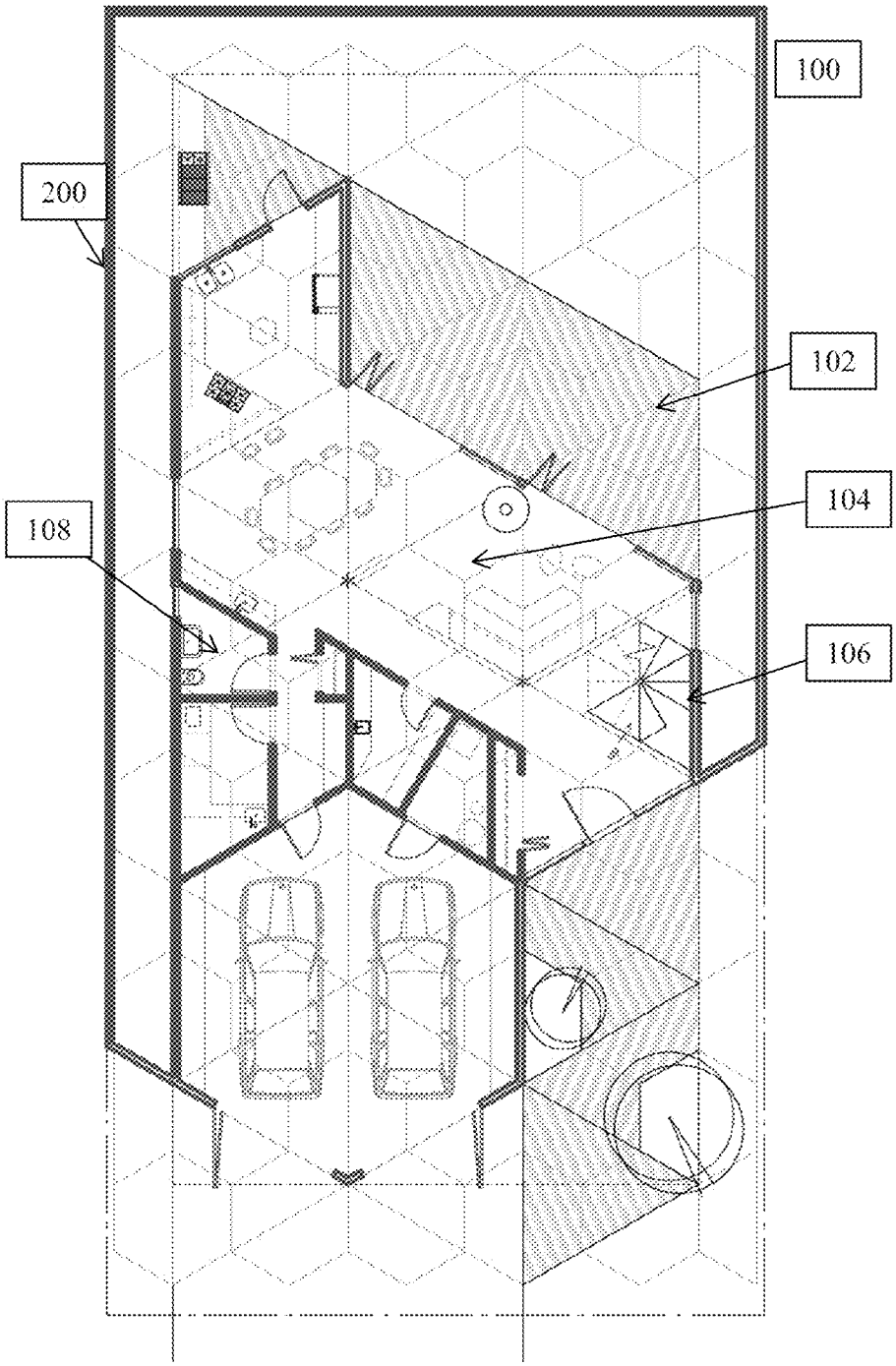
FIG. 11.1

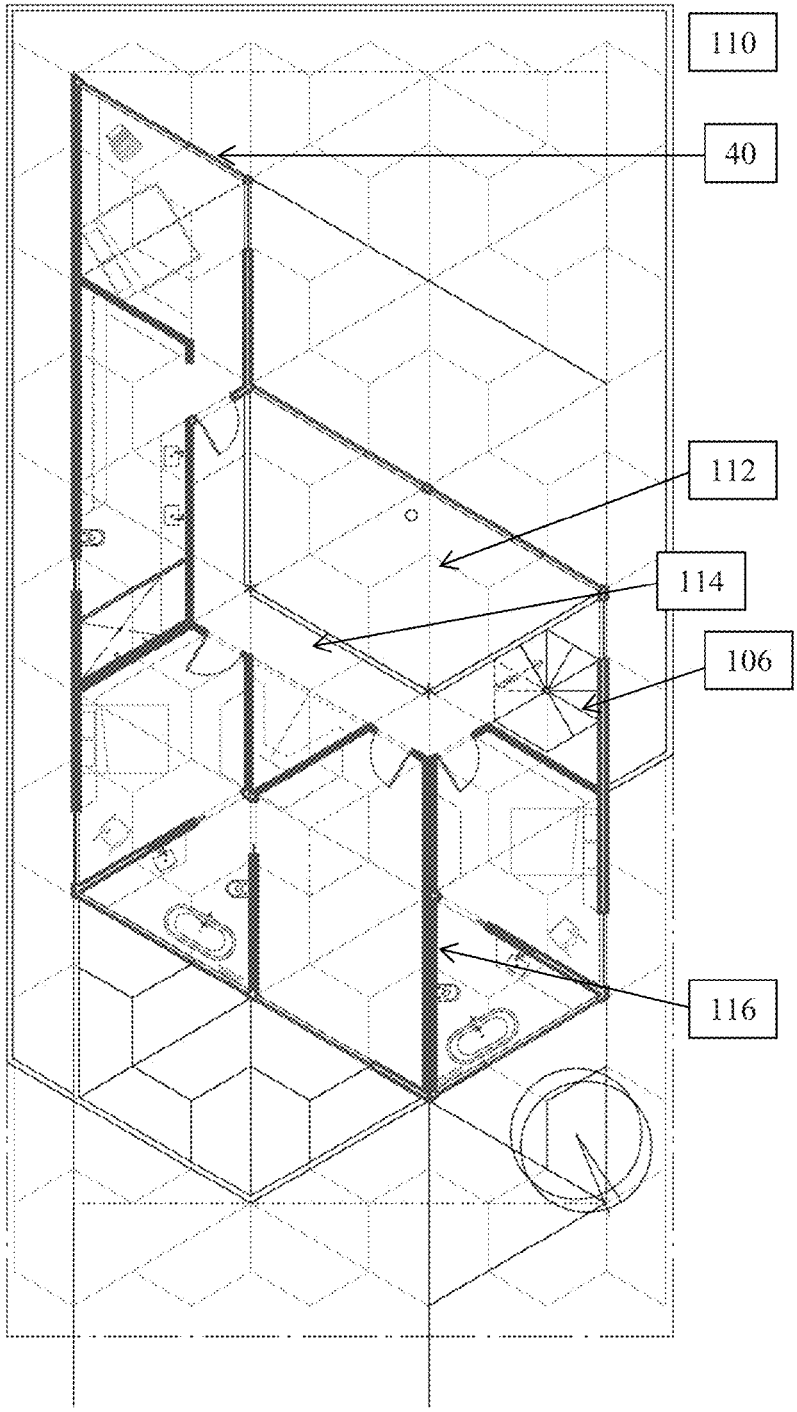
FIG. 11.2

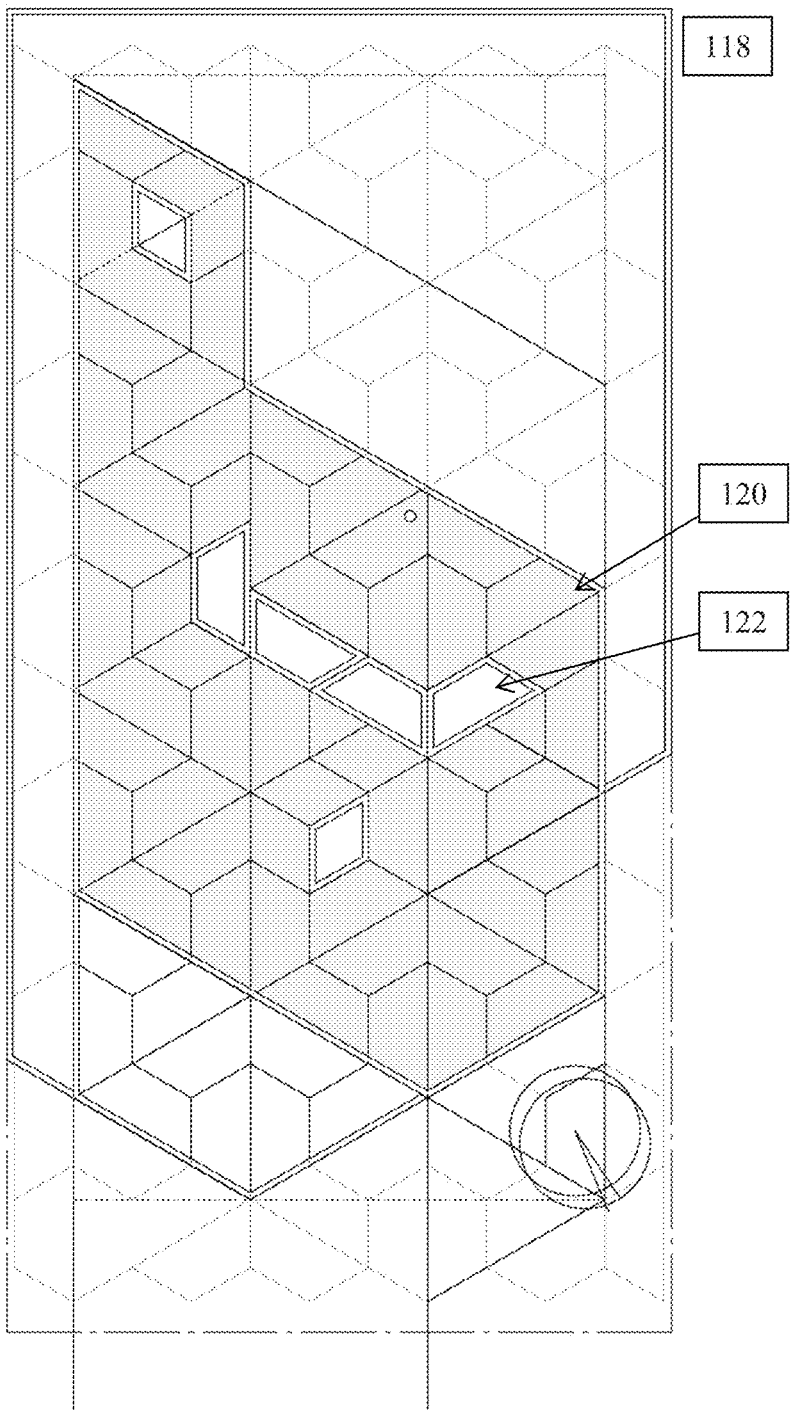
FIG. 11.3

98

MODULAR CONSTRUCTION SYSTEMS AND METHODS

RELATED APPLICATION

This application claims the benefit of and priority to U.S. Provisional Application Ser. No. 61/301,130 filed on Feb. 3, 2010, the contents of which are hereby incorporated by reference as if recited in full herein for all purposes.

BACKGROUND OF INVENTION

The inventive subject matter generally relates to methods, systems and components for modular construction of buildings.

Construction of structures has traditionally used a process wherein raw or processed materials are sent to a construction site where the materials are further adjusted or manipulated to build the structure. This requires a labor intensive process where skilled laborers often make specific measurements in the field and communicate those measurements to someone who proceeds to make an alteration to raw or processed materials. As an example during the construction of a house, a worker may need to lay down a piece of wood flooring as part of a larger wood floor. The worker would measure the length of the opening for the piece of wood. The worker would then take a piece of wood flooring that is longer than the desired finished length, transfer the measurement taken, go to a saw, make a cut to the wood flooring and then attempt to install the piece of wood flooring into the rest of the floor. This process is repeated over and over again in a busy and often hectic environment leaving the worker open to making an error in his measurements or in the placement of cuts. These errors cost not only time and labor, but also wastes valuable material that may need to be replaced. This process and associated potential for error and additional costs are repeated in many other building situations including, installing joists, installing tiles, installing windows or doors, installing roofs, installing sheetrock, and many other elements that go into building a structure.

The use of modular structures and prefabricated materials sought to address some of these limitations wherein a predetermined basic shape and construction technique were used to more rapidly and consistently build structures. Many of these approaches still required a significant amount of assembly of materials at the final construction site and do not allow for significant parts to be constructed off site and transported to the site in an almost finished state. Further, many of these systems do not allow for easy scalability to very large or moderately small structures. Moreover, many of these systems do not allow for effective and easy use of current "green" technology.

As a background to additional construction techniques, U.S. Pat. Nos. 4,295,307, 5,031,371, 5,884,437, 3,645,052, and US Patent Application 2005/0144857 show modular building structures and are hereby incorporated by reference in the entirety for all purposes.

While each of the referenced art techniques disclosed above may have its merits in its own right, there is a need to develop a more versatile, structurally sound, scalable modular building system that is easily and efficiently assembled on the job site and leverages many of the technological advances in construction materials today.

SUMMARY

The inventive subject matter addresses the problems in the prior art by, among other things, providing modules for a building or other structure that are simple and cost efficient to construct and assemble. They also give the architect or designer great latitude in design, allowing for single or multi-story designs of virtually any size. They can also be implemented with eco-friendly material choices.

In certain embodiments, the inventive subject matter is directed to modular subunit based on a frame having three equal-length structural segments joined at each end to form a triangular shape, and wherein the structural segments form a bounded section. The subunit defining the bounded section may be a load bearing structure. The bounded section may include three trapezoidal elements arranged to form a triangle. The bounded section may include one of the following: a flooring system, a wall system, a ceiling system, a roofing system, glass, drop panels, or a void. Structural Insulated Panels (SIPs) or engineered wood I joists, e.g., TJI joists, may be used in the bounded sections to form such systems. A modular unit may be formed having two of the triangular frames separated by a perpendicular column at each corner to form a normal right pentahedral shape; wherein the triangular frame further comprising three equal length structural segments joined at each end forming a triangular shape; and/or wherein the structural segments form a bounded section.

These and other embodiments are described in more detail in the following detailed descriptions and the figures.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show embodiments according to the inventive subject matter, unless noted as showing prior art.

FIG. 11.1 is a floor plan of the first level of one embodiment of a multiple level structure.

FIG. 11.2 is a floor plan of the second level of one embodiment of a multiple level structure.

FIG. 11.3 is a floor plan of the roof level of one embodiment of a multiple level structure.

DETAILED DESCRIPTION

Figure 1:
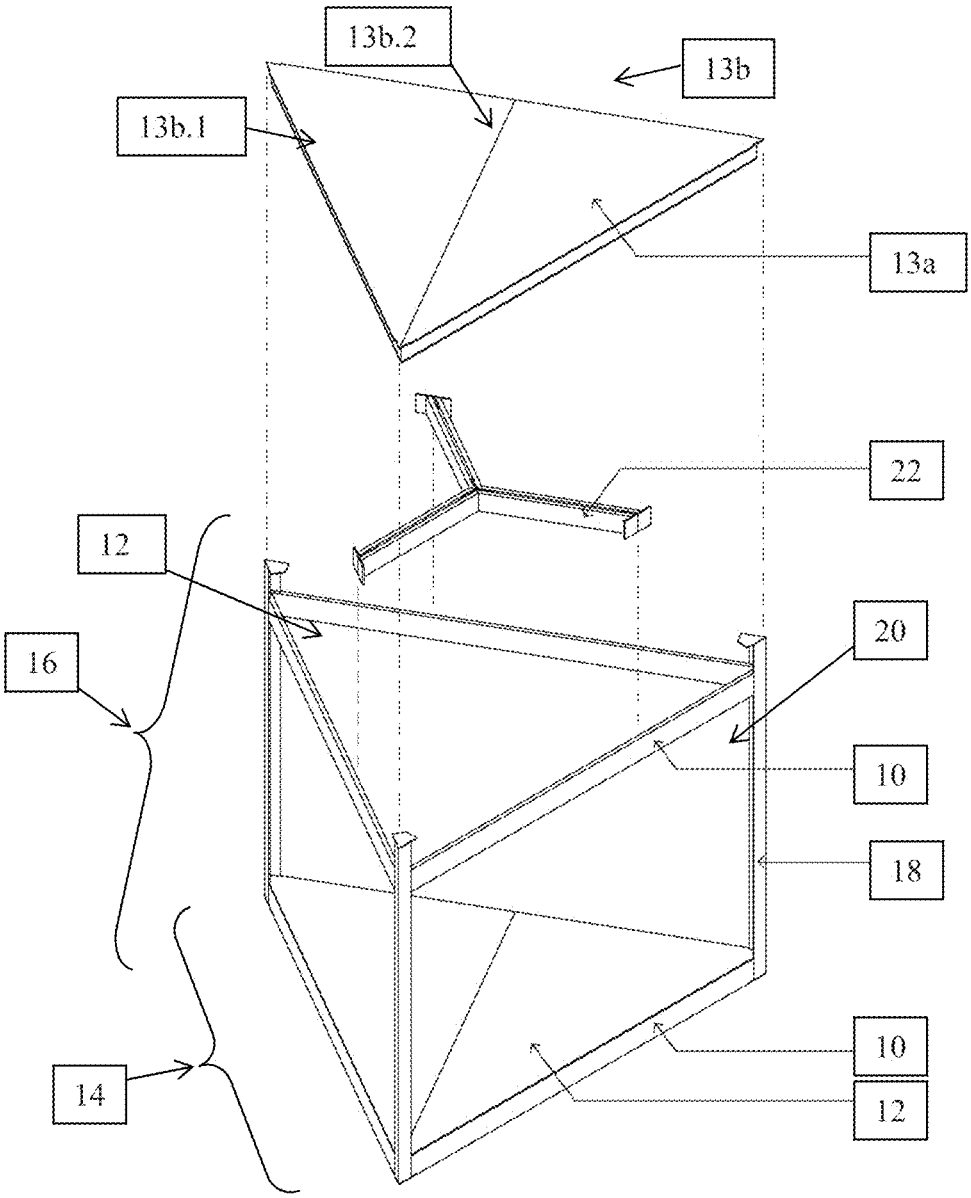
FIG. 1 is an exploded schematic view of one embodiment of a volumetric triangular assembly.

Representative embodiments according to the inventive subject matter are shown in FIGS. 1-15*g*, wherein the same or generally similar features share common reference numerals.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

FIG. 1 shows a triangular frame 14 comprising three substantially equal length structural segments 10 joined at each end forming a triangular frame 14. The structural segments 10 form a bounded section 12. In this example, the triangular form is an equilateral triangle. In this case a structural inset 13*a* occupies this bounded space. It is understood by one skilled in the art that the bounded section 12 may have a load-bearing element or it may be filled with an ornamental element or a combination thereof, or be left empty. At each vertex 26 of the triangular frame 14, a column 18 may be placed extending away from the plane created by the triangular frame 14. One embodiment may provide for the column 18 to be substantially perpendicular to the plane created by the triangular frame 14. With each column 18 having two ends, the first end being connected to one vertex 26 of the triangular frame 14, the second end may be attached in a similar orientation to a second triangular frame 14 substantially set apart from the first triangular frame 14 forming a volumetric triangular assembly 16. In one embodiment the second triangular frame 14 may be substantially parallel to the first triangular frame 14 joined at the respective adjacent vertices 26 by columns 18 to form a normal right pentahedral volumetric shape, i.e., a pentahedron.

A structural segment 10 of a first triangular frame 14 and a substantially parallel structural segment 10 of a second triangular frame 14, in conjunction with adjacent columns 18, may form a wall section 20. In one embodiment, the wall section 20 may be substantially rectangular in shape. The wall section 20 may be filled with a wall system or left empty.

Figure 2:
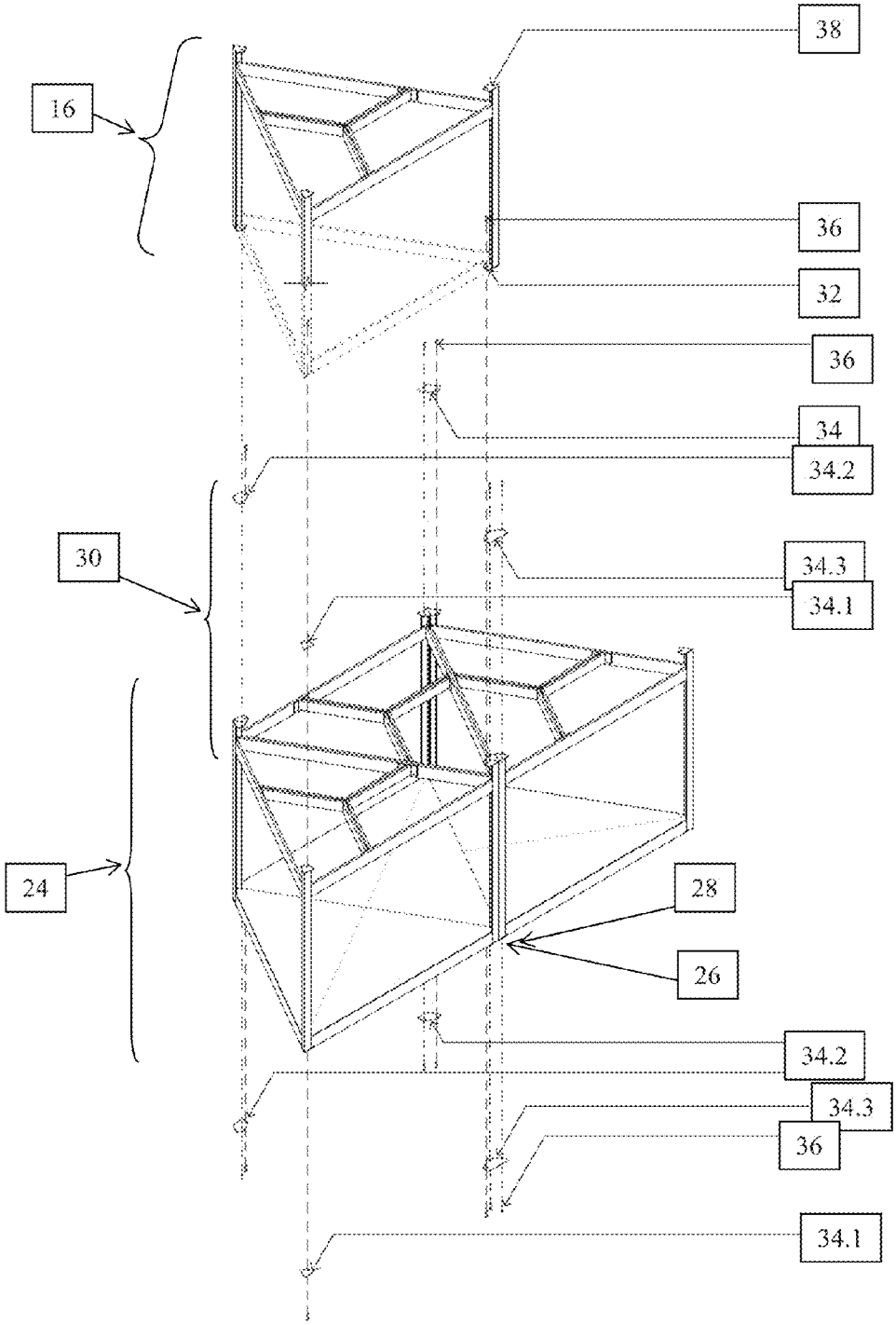
FIG. 2 is an exploded schematic view of one embodiment of a modular structure with a joint system.
Figure 3B:
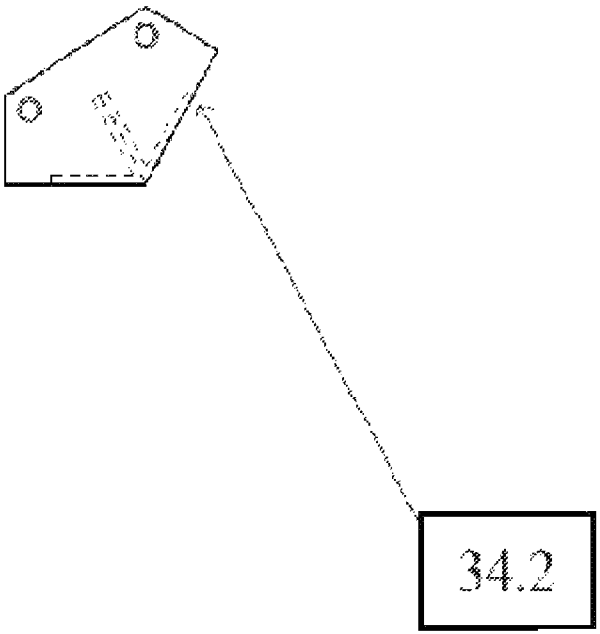
FIG. 3*a*-3*f* show multiple embodiments of connection plates.
Figure 3A:
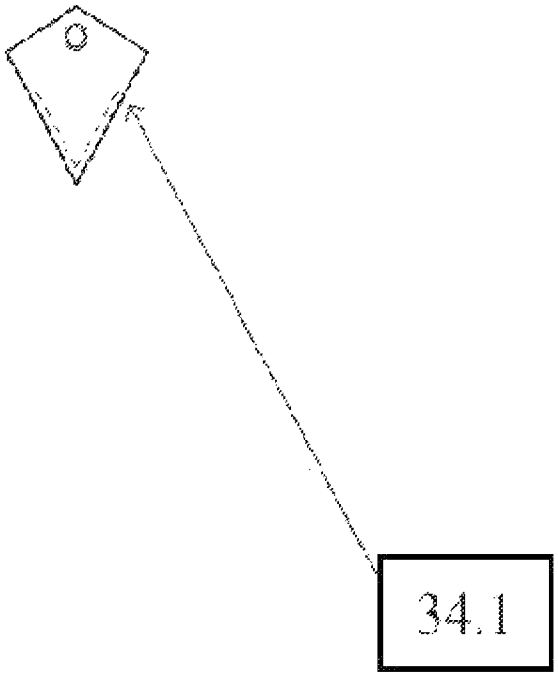
Figure 3C:
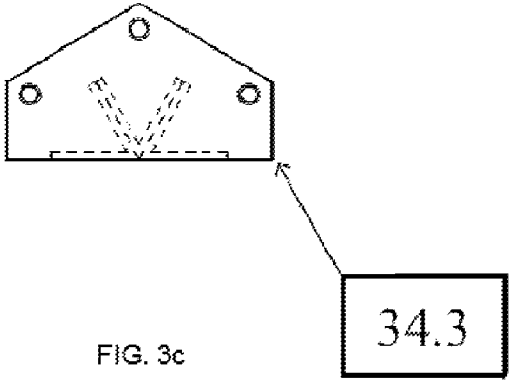
Figure 3D:
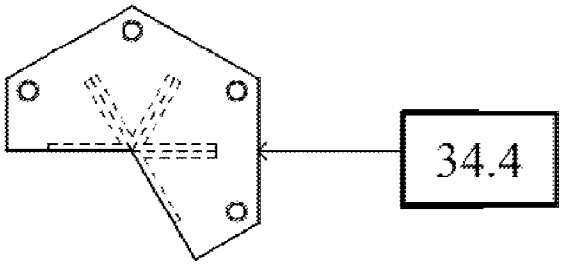
Figure 3E:
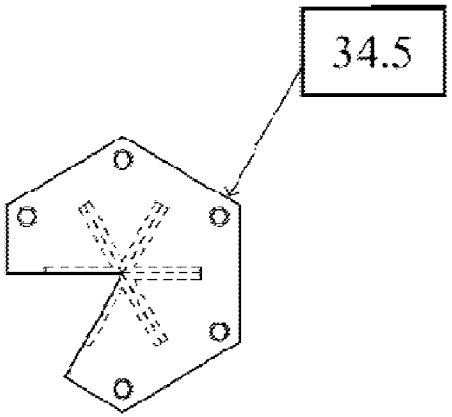
Figure 3F:
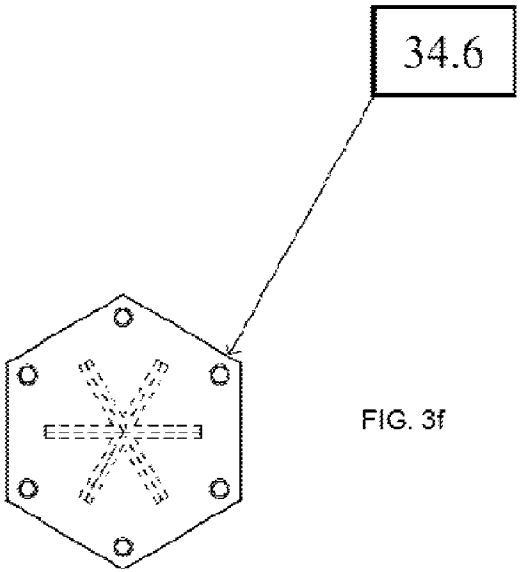
Figure 4:
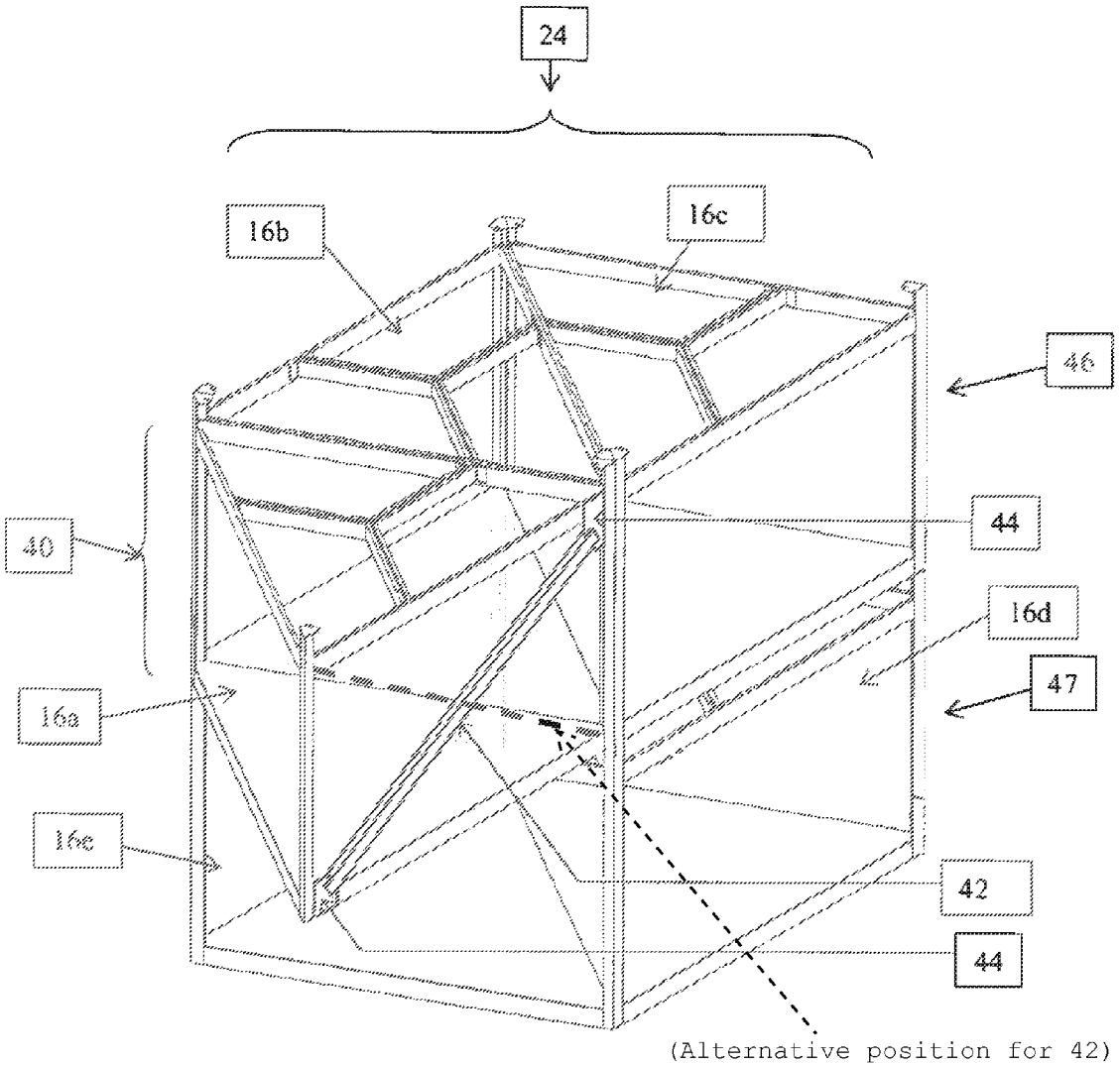
FIG. 4 is an isometric view of one embodiment of a cantilevered section on a multiple level structure.

One embodiment provides for two or more volumetric triangular assemblies 16 to be joined together to form a modular structure 24. In this embodiment, there are three volumetric triangular assemblies 16. The volumetric triangular assemblies 16 may be joined together in a horizontal orientation as illustrated in FIG. 2, or the volumetric triangular assemblies 16 may be joined together in a vertical orientation as illustrated in FIG. 4. Generally, the modular structure assembly is sized and shaped for human occupation, namely it has sufficient headroom and width to be used in some utilitarian capacity by one or more standing humans, such as a house, office, store, garage, shop, shed, barn or other farm or utility building. Typically, such buildings will have a ceiling height of at least 8' and floor dimensions of at least 100 square feet.

Figure 8:
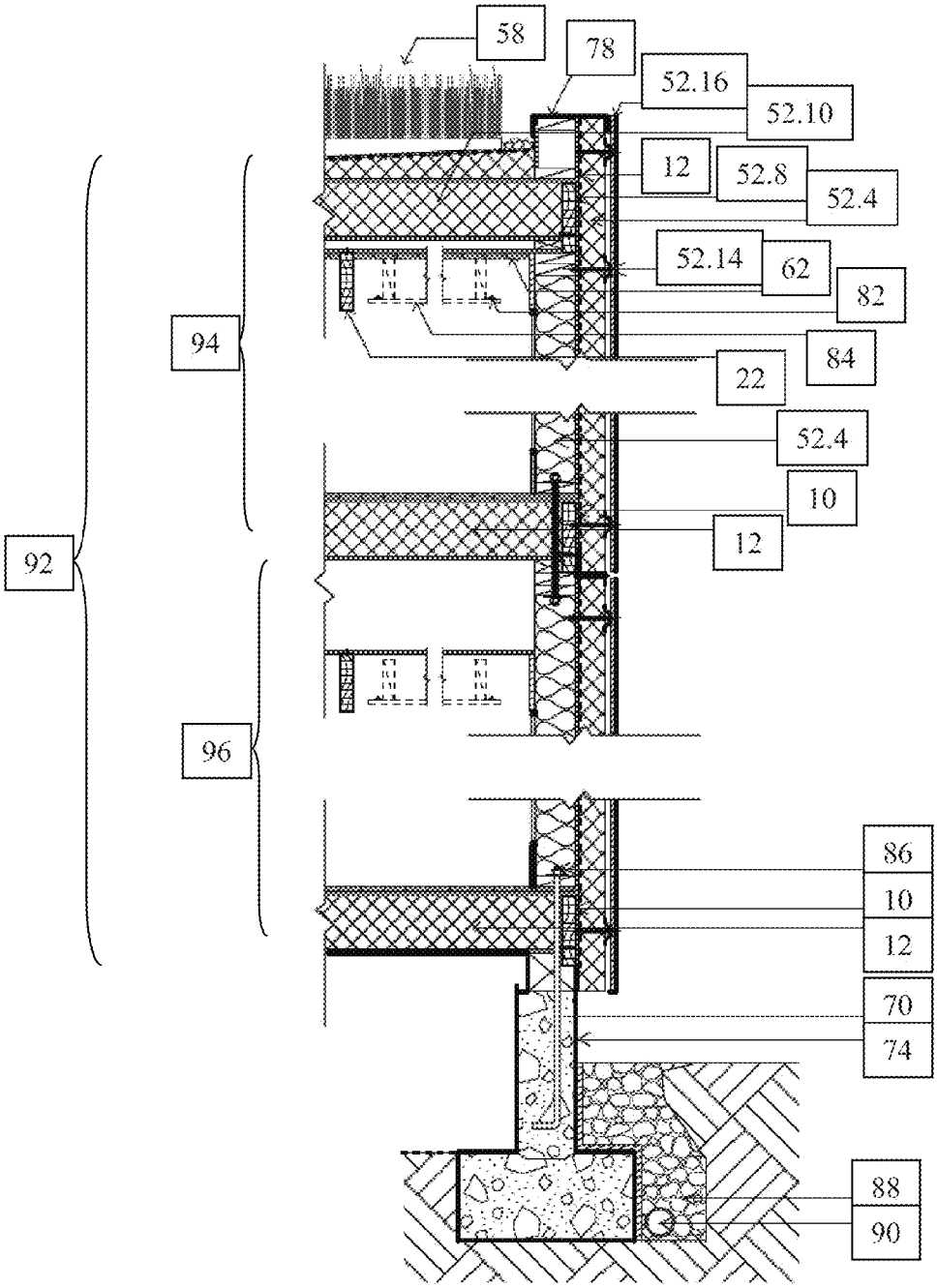
FIG. 8 is a partial cross sectional view of an embodiment of a multiple level modular structure.

The volumetric triangular assemblies 16 may be joined together in a horizontal orientation, as illustrated in FIG. 2, to form a horizontal space 50 or the volumetric triangular assemblies 16 may be joined together in a vertical orientation as illustrated in FIG. 4 to form a multiple level structure or a vertical space 92 as illustrated in FIG. 8

The volumetric triangular assemblies 16 may be joined together to create a modular structure 24 by using a joint system 30. One embodiment of a joint system 30 uses connection plates 34, 34.1-34.6, as illustrated in FIGS. 2 and 3. The connection plates 34 may be tailored to fit the number of volumetric triangular assemblies 16 joined at that particular joint 28. To accommodate a joint system 30 using connection plates 34, the columns 18 may extend a distance beyond the triangular frame's 14 vertex 26 and may be configured to form a column termination plate 32. The column termination plate 32 may be joined to a connection plate configured to the specific number of volumetric triangular assemblies 16 joining together at that joint 28. For example, FIG. 2 shows three volumetric triangular assemblies 16 joining together at a joint 28 (specifically called out in FIG. 2), where the joint is to be joined with a connection plate 34.3. Connection plate 34.3 is configured to join together up to three volumetric triangular assemblies 16. This connection plate 34.3 configuration may be substantially replicated at the adjacent joint directly above. FIG. 3*a*-3*f* show six variations of connection plate 34 wherein connection plate 34.6 may join up to six volumetric triangular assemblies 16, connection plate 34.5 may join up to five volumetric triangular assemblies 16, connection plate 34.4 may join up to four volumetric triangular assemblies 16, connection plate 34.3 may join up to three volumetric triangular assemblies 16, connection plate 34.2 may join up to two volumetric triangular assemblies 16, and connection plate 34.1 may join up to one volumetric triangular assembly 16.

Further, the column termination plate 32 may be joined to a connection plate 34 using fasteners 36. It is understood to one skilled in the art that fasteners 36 may be any common or unique form of fastening or joining two materials together including, but not limited to, screws, nuts and bolts, rivets, nails, welding, clips, adhesive, epoxy, or other form of joint material, structure, or method.

FIG. 4 shows a multiple level modular structure 24 with an upper level 46 and a lower level 47. The upper level 46 is created by the joining of three volumetric triangular assemblies 16*a*-*c*, while the lower level 47 is created by the joining of two volumetric triangular assemblies 16*d*-*e*. FIG. 4 also shows a cantilevered volumetric triangular assembly 40, 16*a* extending the upper level 46 out over an area not directly supported by the lower level 47. The cantilevered volumetric triangular assembly 40, 16*a* may be connected to and supported by the adjacent volumetric triangular assembly 16*b* on the same upper level 46. The cantilevered volumetric triangular assembly 40, 16*a* may also use additional support systems. As the example in FIG. 4 shows, the volumetric triangular assemblies 16*e* and 16*d* directly support volumetric triangular assemblies 16*b* and 16*c* respectively by virtue of each being located directly underneath.

FIG. 4 also shows a structural member 42 connected at each end to non-adjacent vertices 26 of the cantilevered volumetric triangular assembly 40, 16*a* by a structural member attachment system 44. The structural member 42, as seen in FIG. 4, is primarily in tension; however, it is understood to one skilled in the art that if a structural member 42 is installed such that the end adjacent to the supporting volumetric triangular assemblies 16*b* is placed on the lower vertex 26 and the other end is joined to a nonadjacent vertex 26 (the dashed line labeled on the alternative postion for structural member 42), the structural member 42 will primarily be in compression.

Figure 5:
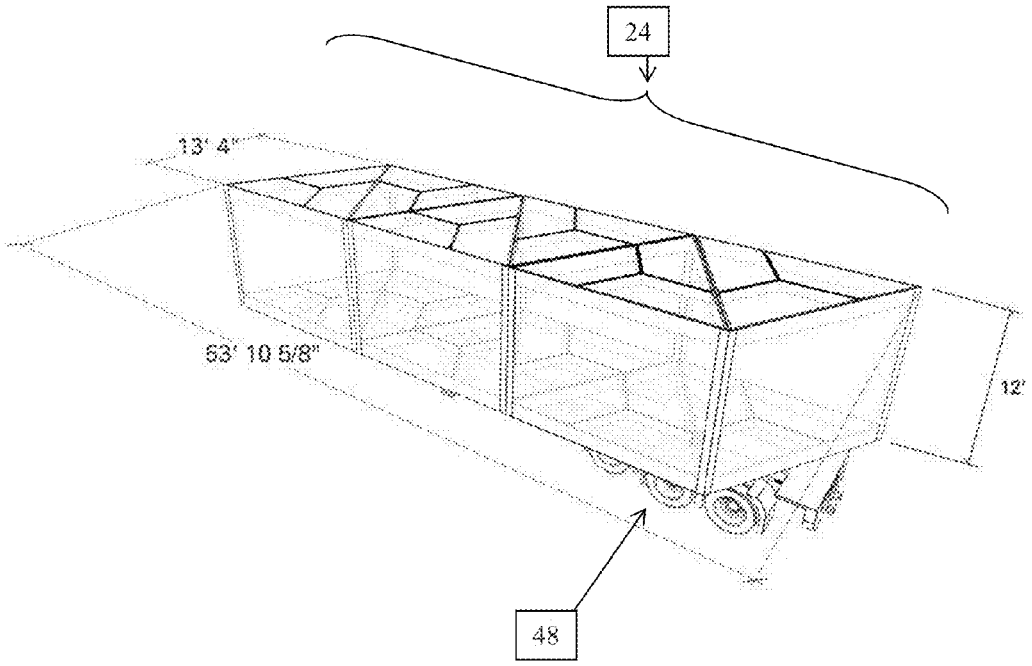
FIG. 5 is a perspective view of one embodiment of a modular section loaded on a transportation system.

Volumetric triangular assemblies 16 may be joined together to create modular structures 24 at a location away from the final construction site. Modular structures 24 may be designed and assembled to fit on common transportation systems 48 as seen in FIG. 5. Modular structures may then be joined together to create larger modular structures 24 or superstructure at a final construction site. One embodiment as shown in FIG. 5 shows six volumetric triangular assemblies 16 joined together for form a modular structure 24 with an approximate size of 12 feet tall, 13'4" wide and 53'11" long. It is understood by one skilled in the art that these dimensions are approximate and designed to fit within common department of transportation limitations, if being shipped by land. It is further appreciated by one skilled in the art that these dimensions may easily be scaled by design to fit such logistical limitations. Further, the number of volumetric triangular assemblies 16 joined to create the modular structure 24 to be transported may be varied to fit the logistical limitations or as required by the final construction plan. FIG. 5 shows a modular structure 24 connected to a transportation system 48 which can take the form of any general or dedicated transportation system including, but not limited to, a trailer system, a train car system, a boat system, sled system, helicopter, crane, airplane, spacecraft, or other forms of transportation.

The column termination plate 32 and column 18 may be orientated to create a coupling site 38, which may be used for connection to other volumetric triangular assemblies 16 or transportation systems 48. One embodiment of a coupling site 38 configured for transportation provides for a removably coupleable system. It is understood to one of ordinary skill in the art that a removably coupleable system may include, but is not limited to, eye-bolts being attached to the modular structure 24 and a rigging system on a crane or lifting system, simple nut and bolt configuration. Another option if to use a threaded rod and nut fastener to achieve a vertical attachment of stacked modules.

The bounded section 12 may be a floor system or a ceiling system, as commonly known to one skilled in the art or as becomes known. The floor system may be a traditional or modern floor system, including, but not limited to, beams with joists connected and covered with sheathing, or a subfloor covered with a finished floor. Finished flooring may include carpet, tile, wood, heating/cooling system, or other materials of systems found in floors or ceilings. Further, the floor system may include a glass or other transparent or semi-transparent material sections.

Additionally, the floor system may include the use of a structural insulated panel 13*b* (hereafter "SIP"). One embodiment using a SIP 13*b* may be constructed by taking a SIP formed into a standard rectangular shape and sized such that one diagonal cut of the rectangular SIP will create two triangle shaped SIP sub-triangles 13*b*.1. SIP sub-triangles 13*b*.1 are sized to fit into the bounded section 12 when joined together by rotating and translating one SIP sub-triangle 13*b*.1, causing it to be orientated with the second SIP sub-triangle 13*b*.1 to create a larger triangle shaped SIP 13*b*. This arrangement causes SIP 13*b* to be substantially coextensive with the bounded section 12, and thus requiring minimal subsequent measurements or adjustments. FIG. 1 shows an embodiment of a SIP 13*b* so sized, cut, orientated, and joined. Additionally, the two SIP sub-triangles 13*b*.1 may be joined together by inserting a beam structure along the adjacent substantially coextensive edges of the SIP joint 13*b*.2 of the SIP sub-triangles 13*b*.1 so joined.

One embodiment of a ceiling system may include the use of a tri-spoke frame 22. One embodiment of the tri-spoke frame 22 is the frame having three ends emanating from a central point within the bounded section with ends attachable to each adjacent structural segment 10 at a point away from the central point, thus creating three trapezoidal shaped regions within the bounded section 12. This creates a system wherein standard sized sheet material may be modified to fit within the trapezoidal openings. Standard sized sheet material may be in the form of plywood, fiberboard, or other manmade material, such as traditional drop-down panels.

Figure 7:
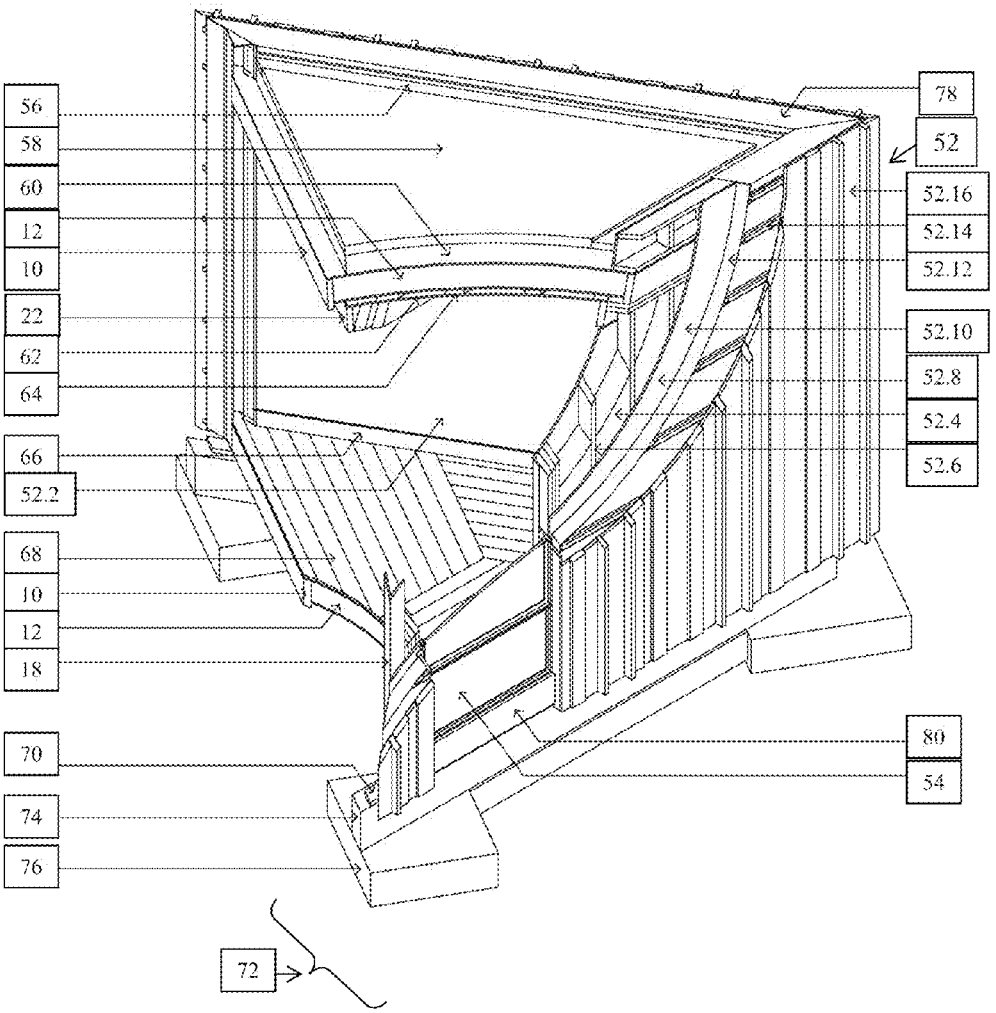
FIG. 7 is a partial cutaway of an isometric view of one embodiment of a volumetric triangular assembly.

Further, an embodiment of a ceiling may be a standard ceiling system including wall gypsum, rafters, insulation (e.g., bat insulation, rigid insulation, or spray foam insulation), and the like. Additionally, another embodiment may include ceiling material 62, furring 64, rigid insulation 60, as shown in FIG. 7. Further, the ceiling system and roofing system may be combined such that there is not a distinct separating interface. As shown in FIG. 7, a roof system 58 may be used in conjunction with a ballast system 56, rigid insulation 60, and a cap 78. One skilled in the art will appreciate that green roofing systems may be used, as well including biological material, including grasses and other plants.

Additionally, the bounded section 12 may be left empty allowing access to the adjacent volumetric triangular assembly 16 or to the areas outside the modular structure 24.

One skilled in the art will appreciate that a wall system 20 may be a conventional wall system, a door system, a window system, glass system, other material system, or alternative system. The system may be structural, purely decorative or a combination of the both.

Figure 6:
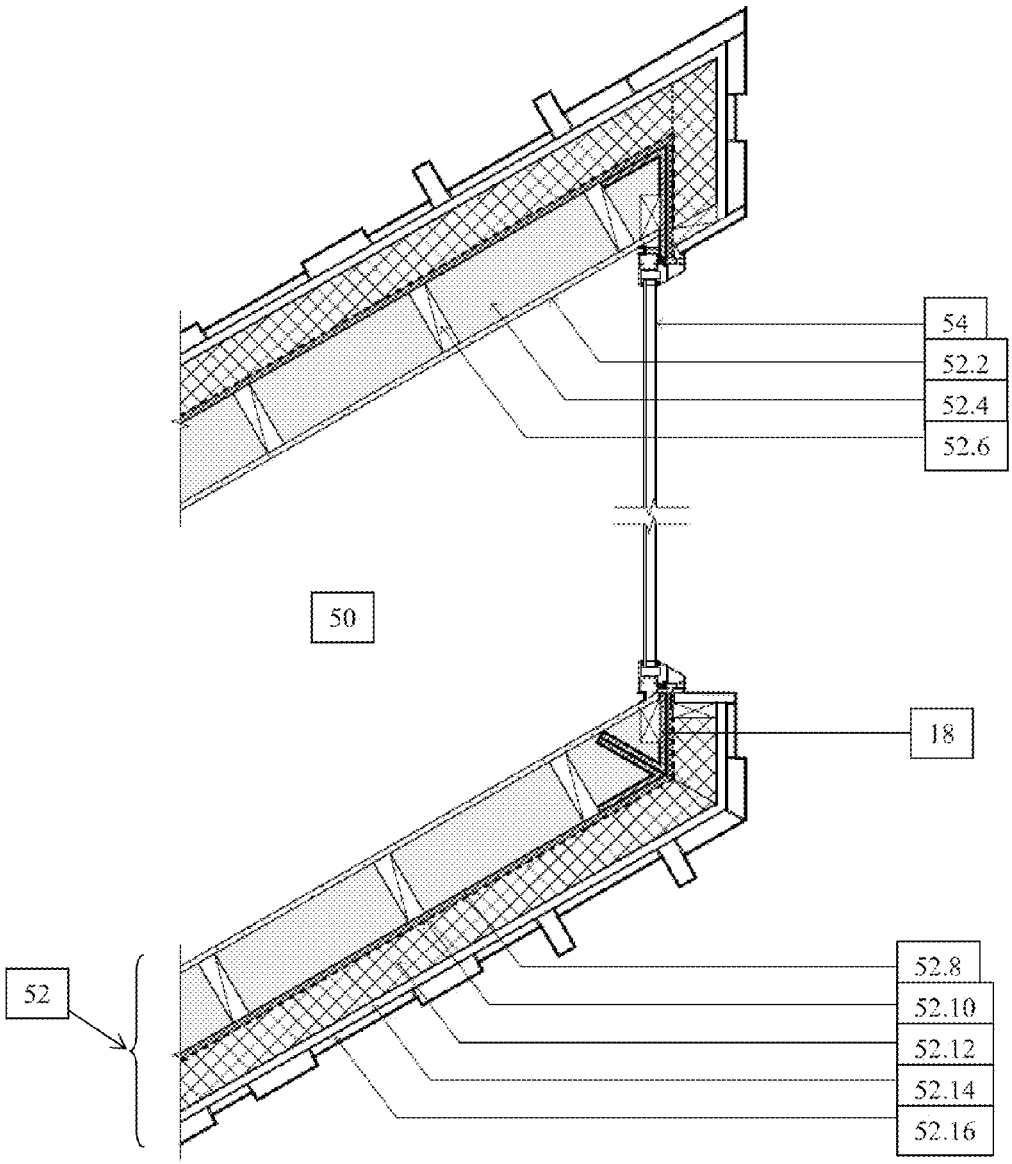
FIG. 6 is a partial plan view of one embodiment showing multiple volumetric triangular assemblies joined together creating a modular section with a horizontal space using an insulated wall and window system.

FIG. 6 shows a partial plan view of one embodiment showing portions of at least two volumetric triangular assemblies 16 creating a horizontal space 50 spanning between the two shown volumetric triangular assemblies 16. FIG. 6 also shows one embodiment of a wall system 52 to fill a wall section 20 using wall gypsum 52.2, spray foam insulation 52.4, wood framing 52.6, wall sheathing 52.8, moisture barrier 52.10, rigid insulation 52.12, furring strip 52.14, and siding module 52.16. FIG. 6 also shows use of a window system 54 to fill a wall section 20.

FIG. 7 shows a partial cutaway of an isometric view of one embodiment of a volumetric triangular assembly. This embodiment shows a wall system 52 using wall gypsum 52.2, spray foam insulation 52.4, wood framing 52.6, wall sheathing 52.8, moisture barrier 52.10, rigid insulation 52.12, furring strip 52.14, and siding module 52.16, as well as a window system 54 and insulation and panel system 80.

FIG. 7 also shows a foundation system 72 that may use a mudsill 70, stem wall 74, and footing 76.

FIG. 8 shows a partial cross sectional view of an embodiment of multiple level modular structure 24 with an upper assembly 94 connected to a lower assembly 96. This embodiment shows a wall system 52 using spray foam insulation 52.4, wall sheathing 52.8, moisture barrier 52.10, furring strip 52.14, and siding module 52.16, and ceiling material 62, ceiling panel 84, lighting system 82, as well as a foundation attachment system 86, a mud sill 70 and stem wall 74.

Figure 9:
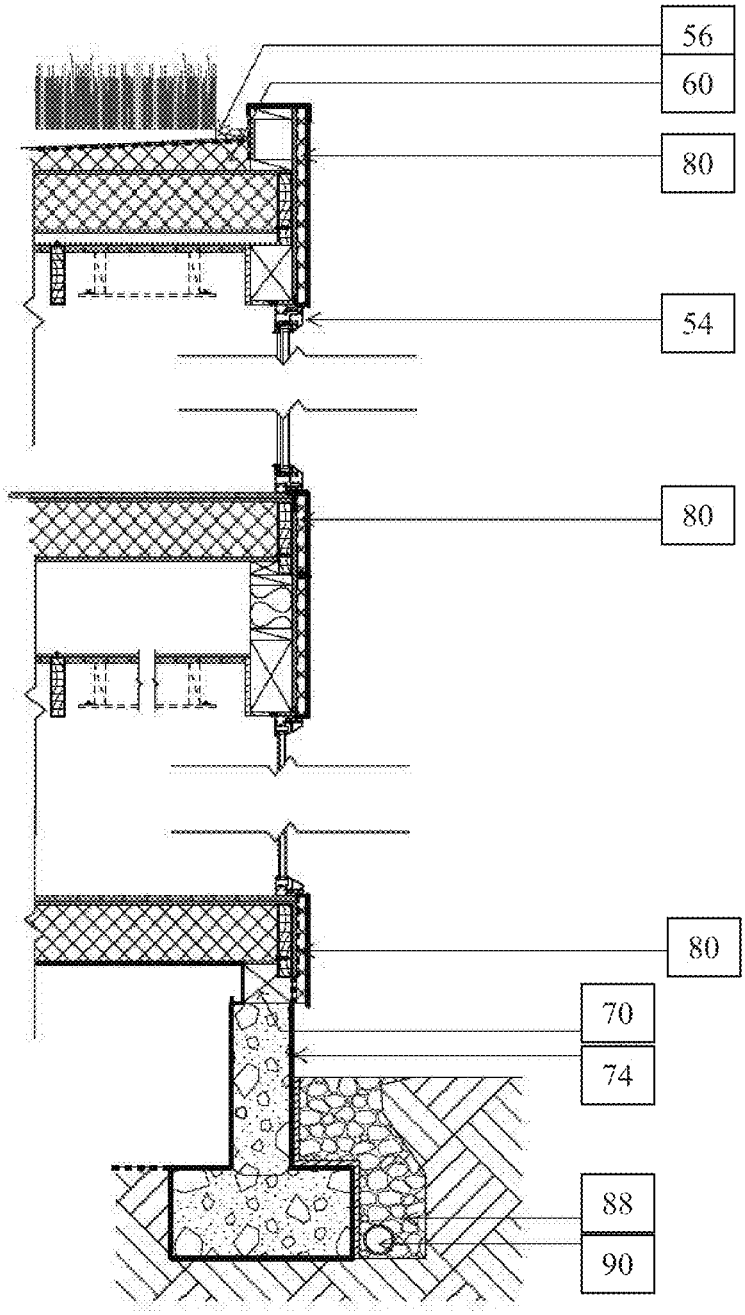
FIG. 9 is a partial cross sectional view of an embodiment of a multiple level modular structure.

FIG. 9 also shows a partial cross sectional view of an embodiment of multiple level modular structure 24. This embodiment shows a window system 54, with insulation and panel system 80 and part of the roof and ceiling system using ballast 56 and rigid insulation 60, as well as a stem wall 74 with a mud sill 70 and a drainage system 90 covered with backfill 88.

Figure 10:
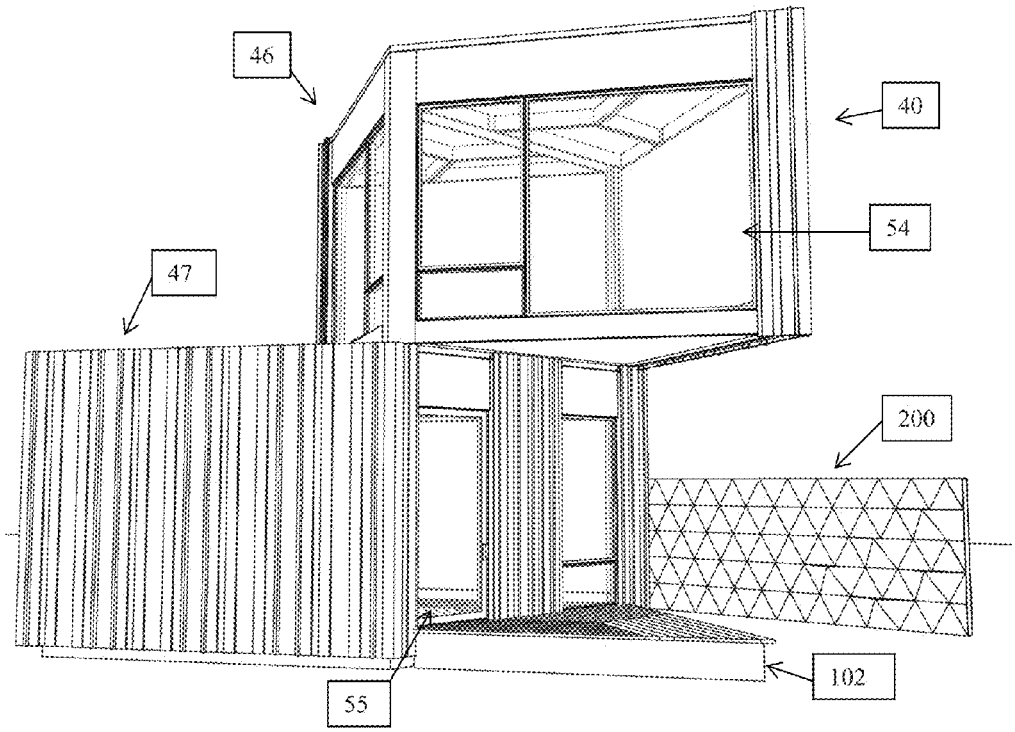
FIG. 10 is an elevation view of an embodiment of a modular structure with a cantilevered section, decking, windows, and modular wall system.

FIG. 10 shows an elevation view of an embodiment of a modular structure 24 with a cantilevered volumetric triangular assembly 40. Additionally, FIG. 10 shows a window system 54, a door system 55, patio or deck system 102, an upper level 46, a lower level 47, and a modular wall system 200.

FIGS. 11.1, 11.2, and 11.3 show floor plans of an embodiment of a multiple level modular structure 24. FIG. 11.1 shows a first level 100 with a patio or deck system 102, an internally open space 104, a stair system 106, multiple and varied internal space dividers. One skilled in the art will appreciate that the internally open space 104 may be open horizontally to adjacent volumetric triangular assemblies 16 on the same level or vertically to adjacent volumetric triangular assemblies 16 on a level above or below the current level. Further, one skilled in the art will appreciate that a stair system 106 may be substituted with other ways of getting from one level to another including, but not limited to, ladders, elevators, and poles.

FIG. 11.2 shows a second level 110 with a cantilevered volumetric triangular assembly 40, an internally open space 112, an internally open balcony space 114, sound reducing internal wall 116, and a stair system 106.

FIG. 11.3 shows a roof level 118 with a roof system 120 and skylight window system 122.

Figure 12:
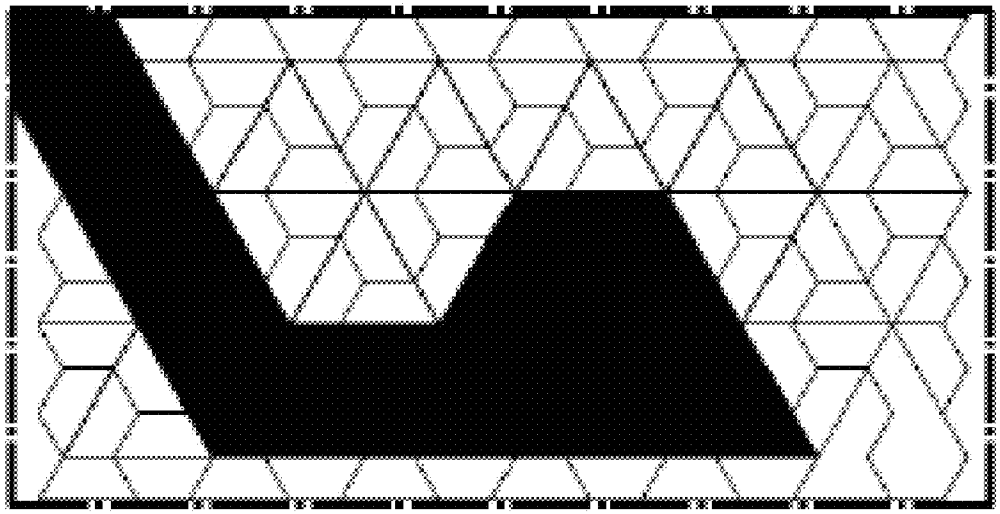
FIG. 12 shows an illustrative example of how embodiments of the inventive subject matter may be used to create a courtyard or courtyard effect within a structure.

FIG. 12 shows a unique aspect of a modular system described herein, including the flexibility of the system to create floor layouts to create a courtyard including a courtyard layout 98, where the voided region represents a courtyard. Accordingly, the modules enable an integration of indoor and outdoor spaces, breaking down the traditional approach of an object on a field.

Figure 13:
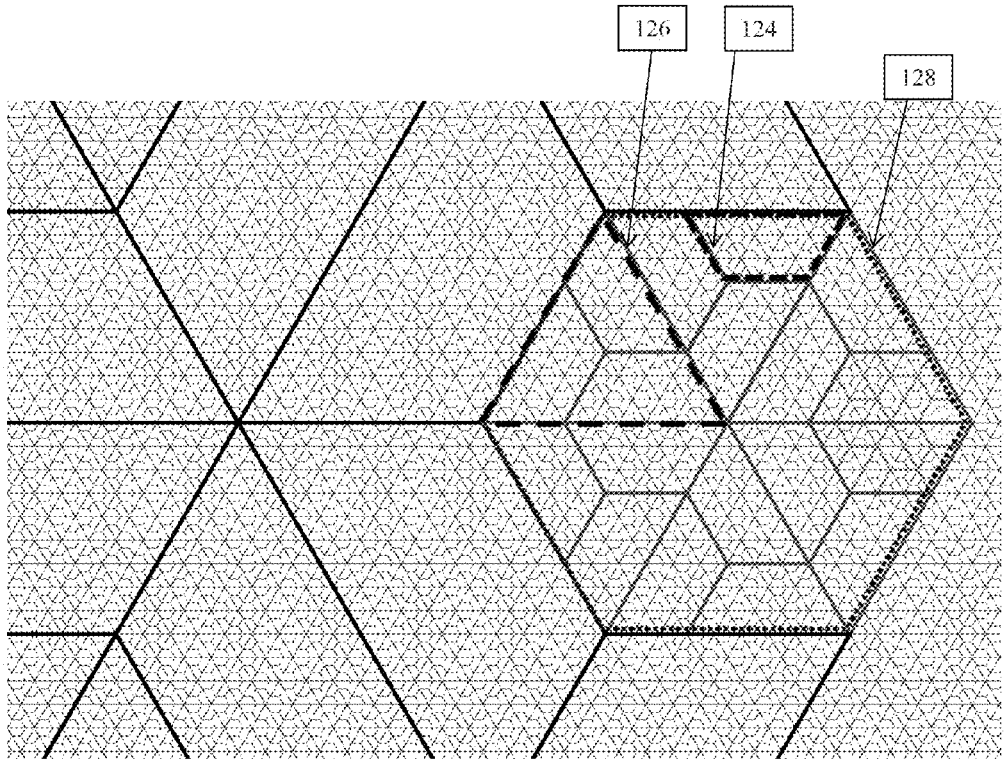
FIG. 13 shows a grid pattern with examples of some of the scalable geometric features and combinations that may be used by the inventive subject matter.
Figure 14A:
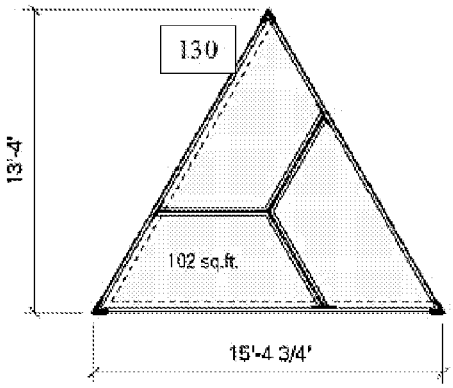
FIG. 14*a*-14*d* are schematic views of four of the many possible geometric embodiments of the inventive subject matter.
Figure 14B:
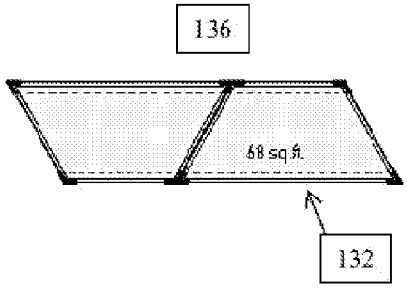
Figure 14C:
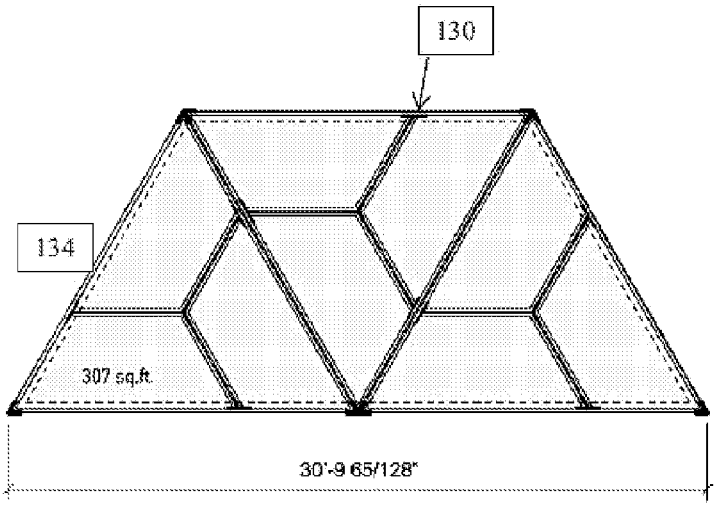
Figure 14D:
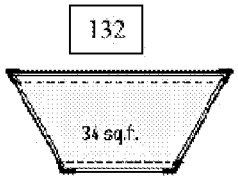
Figure 15A:
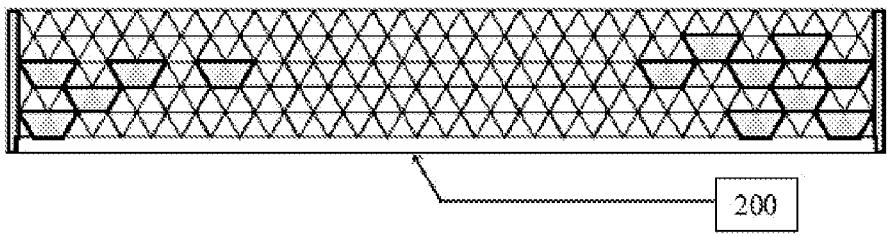
FIG. 15*a*-15*g* are side views of one embodiment of a modular wall system with some of the possible wall elements enlarged and shown in a schematic view.
Figure 15B:
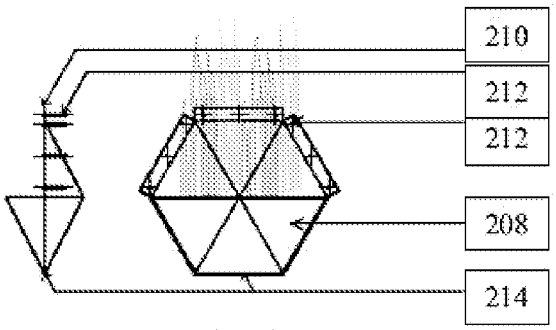
Figure 15C:
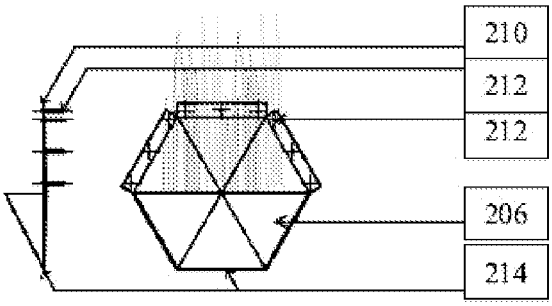
Figure 15D:
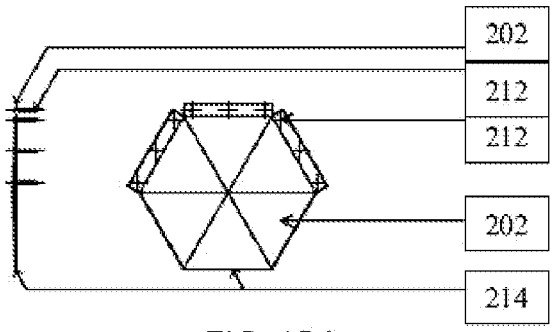
Figure 15E:
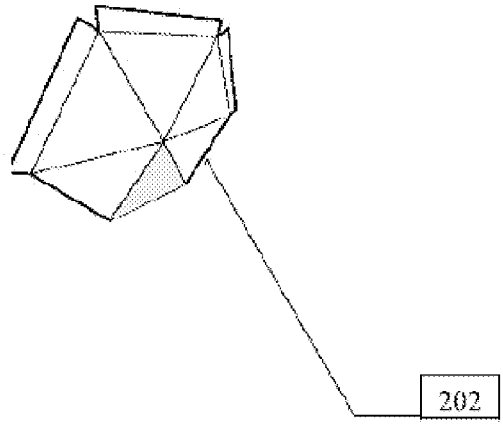
Figure 15F:
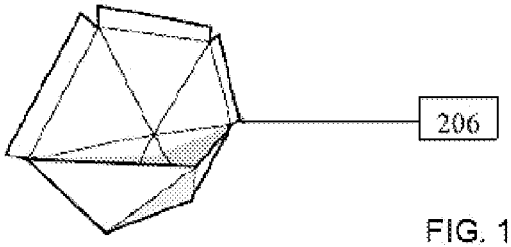
Figure 15G:
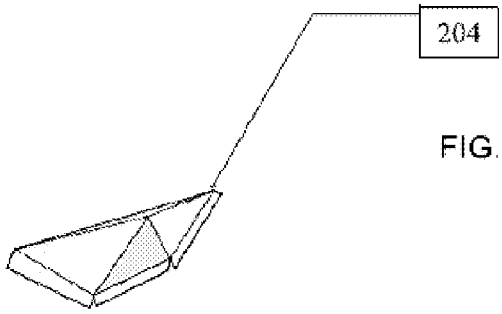

FIG. 13 shows the unique scalability of a modular system described herein. The interrelated geometry of trapezoids, triangles, and hexagons allow for intricate patterns to be used and structures to be scaled. As shown in FIG. 13, a triangle shape 126 may be constructed with three trapezoid shapes 124 arranged in a pinwheel orientation. Additionally, a hexagon shape 128 may be constructed by joining together six triangular shapes 126. Further, a trapezoid shape 124 may be constructed by three smaller inscribed triangle shapes, which in turn may be constructed by three smaller inscribed trapezoid shapes. This process of construction by smaller parts may be repeated down to a crystalline level and perhaps beyond. Similarly, this process of constructing larger shapes from smaller shapes may be repeated and scaled up to modular structures of enormous size.

FIG. 14*a*-14*d* show some embodiments of structural shapes that may be used in constructing a modular structure. A triangular frame 130 may be created by smaller trapezoidal frames 132 joined together. Further, trapezoidal frames 132 may be used in isolation and joined to a larger structure without being specifically joined into a triangular shape 130. One example is the parallelogram modular structure 136 wherein two trapezoidal modular structures 132 are joined together. Additionally, triangular frames 130 may be joined together to form a trapezoidal modular structure 134. The trapezoidal modular structure 134 is an example of the scalability discussed above with regards to FIG. 13.

FIG. 14*a*-14*d* also show one embodiment of the possible general sizes the frames and modules might be. A triangular frame may be approximately 15'5" at one leg with another leg of approximately 13'4", resulting in a plan form area of approximately 102 square feet. A trapezoidal frame 132 may be so dimensioned to result in a plan form area of approximately 34 square feet. A parallelogram modular structure 136 may be so constructed to result in a plan form area of approximately 68 square feet. Accordingly, a trapezoidal modular structure 134 may have an approximate length of 30'10" and a width of 13'4" with a resulting plan form area of approximately 307 square feet. Some embodiments include adjustable sections to build in scalability such that the size of the triangular frame 130 may be adjusted on site, for example, scaled 12' to 15' in height and 14' to 17'.

One of the many advantages of sizing the frames and resulting modular structures this approximate size is that it allows for transportation on most existing forms of surface transportation of pre-assembled volumetric triangular assemblies including trailers and trains, while allowing for simplified construction with use of existing and readily available, standard-sized, materials including SIPs and plywood sheets.

Another advantage of an embodiment is the ability to assemble one or more volumetric triangular assemblies 16 into modular structures 24 at a location away from the final construction site, then transporting those modular structures 24 to a final construction site, and assembling them into a larger modular structure 24 or super structure.

One possible aspect in the transportation and assembly process may include placing removably coupled connectors on the modular structure 24 to be transported, attaching to those connectors, applying sufficient force to those connectors to lift the structure and moving it onto a transportation system. Then the modular structure 24 may be secured to the transportation system by some fashion that may include bolting, strapping, clipping, an adhesive, a retaining edge or mechanical feature, or gravity for transport. The modular structure 24 may then be transported to the final construction site and unloaded in a similar fashion and ultimately placed as part of a final modular structure.

FIG. 15*a*-15*g* show a side view of one embodiment of a modular wall system 200 with some of the possible wall elements enlarged and shown in a schematic view. Full fence units 202 may be joined together to create a modular wall system 200. Additionally, partial fence units 204, may be integrated to give a finished look. Planter units 206 and deep planter units 208 may also be integrated to provide a natural element to the wall by providing for places to plant plants with integrated drainage system 214. The different modules of the modular wall system 200 may be joined together by removable fastener tabs 210 and fasteners 212. One embodiment of the wall may be constructed by assembling the units in a shingled pattern wherein the units higher up on the wall cover the fastener tabs and fasteners 212 of the lower adjacent units.

All patent and non-patent literature cited herein is hereby incorporated by references in its entirety for all purposes.

The invention claimed is:

1. A modular structure forming a least a portion of a building that is sized and shaped for human occupancy, the modular structure comprising two or more volumetric triangular assemblies having vertexes coupled together wherein each volumetric assembly includes a pair of spaced apart, opposing frames, each frame comprising a triangle, the sides of the triangle defining a bounded section enclosing and coupled to a tri-spoke structural inset, the tri-spoke structural inset consisting of three spokes extending from a central point, each spoke having an end coupled to a different, given corresponding side of the triangle.

2. The triangle of claim 1, wherein each spoke end lands between the end points for said different, given corresponding side of the triangle.

3. The triangle of claim 1, wherein the triangle comprises an equilateral triangle.

4. A modular structure forming at least a portion of a building that is sized and shaped for human occupancy, the modular structure comprising:

a plurality of normal, right pentahedrons having a volumetric space for human occupancy coupled together to form an assembly;

each of said plurality of pentahedrons comprising:

a first triangular frame having three sides adjoined to form three vertexes and defining a triangular bounded section;

a second triangular frame having three sides adjoined to form three vertexes and defining a triangular bounded section, wherein said second triangular frame is parallel and spaced apart from said first triangular frame;

wherein each of said three vertexes of said first triangular frame aligns with a corresponding one of said thee vertexes of said second triangular frame, forming three pairs of opposing vertexes, and each vertex in each of said three pairs is coupled to a structural support column disposed between the vertexes of each of said three pairs, thereby the first and second triangular frames and said structural support columns define each of the plurality of normal, right pentahedrons;

at least two of said first and second triangular frames having a structural inset within the triangular bounded section and coupled to the triangular frame, wherein the triangular bounded section is divided by the structural inset into three trapezoids that fill the space of the triangular bounded section;

wherein the plurality of pentahedrons in the assembly align by pairing at least three vertexes on one of said plurality of pentahedrons with at least three vertexes on another one of said plurality of pentahedrons.

5. The modular structure of claim 4, wherein the paired vertexes of aligned pentahedrons are coupled via a joint system, the joint system comprising one or more of the following: a connection plate engaging one or more columns; a connection plate coupling one or more other connection plates; and a connection plate coupling one or more floors or ceilings.

6. The modular structure of claim 4, wherein two or more of the plurality of polyhedrons are coupled together vertically to define as building space, wherein a pair of the structural support columns of a first of the two or more pentahedrons align axially with a pair of the structural support columns a second of the two or more pentahedrons, thereby vertically aligning the corresponding sides of the first and second triangular frame of the first and second of the two or more pentahedrons which are supported between said pair of the structural support columns.

7. The modular structure of claim 6, wherein an upper pentahedron of the two or more of the plurality of polyhedrons includes a floor.

8. The modular structure of claim 6, wherein a lower pentahedron of the two or more of the plurality of polyhedrons includes a ceiling.

9. The modular structure of claim 4, wherein two or more of the plurality of polyhedrons are coupled together horizontally to define as building space, wherein a pair of the structural support columns of a first of the two or more pentahedrons align adjacent with a pair of the structural support columns a second of the two or more pentahedrons, thereby horizontally aligning the corresponding sides of the first and second triangular frame of the first and second of the two or more pentahedrons which are supported between said pair of the structural support columns.

10. The modular structure of claim 4, wherein two or more of the plurality of pentahedrons are coupled together horizontally to form an upper level and are supported by one or more of the plurality of pentahedrons the assembly; wherein one or more of the two or more pentahedrons is a cantilevered pentahedron.

11. The modular structure of claim 10, wherein a tension structural member having a first end and a second end is coupled at the first end to a lower one of the vertexes of the one or more cantilevered pentahedron and coupled at a second end to an upper, non-adjacent one of the vertexes of the one or more cantilevered pentahedron.

12. The modular structure of claim 10, wherein a compression structural member having a first end and a second end is coupled at the first end to an upper one of the vertexes of the one or more cantilevered pentahedron and coupled at a second end to a lower, non-adjacent one of the vertexes of the one or more cantilevered pentahedron.

13. The modular structure of claim 4, wherein two or more of the plurality of pentahedrons are adjacent to each other, the two or more of the plurality of pentahedrons having at least one empty triangular bounded section adjacent to at least one empty triangular bounded section, creating a vertical open space.

14. The modular structure of claim 4, wherein two or more of the plurality of pentahedrons are adjacent to each other, the two or more of the plurality of pentahedrons having at least one empty wall section disposed adjacent to at least one empty wall section, creating a horizontal open space.

15. The modular structure of claim 4, wherein two or more of the plurality of Pentahedrons are arranged to create a courtyard.

16. The modular structure of claim 4, wherein at least one of the paired vertexes of aligned pentahedrons comprises an upper joint, and wherein the upper joint is configured to be removably couplable to a hoist system.

17. The modular structure of claim 16, wherein the hoist system is a crane or lift.

18. The modular structure of claim 4, wherein at least one of the paired vertexes of aligned pentahedrons comprises a lower joint, and wherein the lower joint is configured to be removably couplable to a transportation system.

19. The modular structure of claim 18, wherein the transportation system is a truck or a train.

20. The modular structure of claim 4, wherein two or more of the plurality of pentahedrons and a resulting modular structure are sized and configured for shipment on a truck trailer of a certain dimension so that at least six of the plurality of pentahedrons volumetric triangular assemblies may be shipped.

21. The modular structure of claim 4, wherein two or more of the plurality of pentahedrons and a resulting modular structure are sized and configured for shipment on a truck trailer of a certain dimension so that at least six of the plurality of pentahedrons may be shipped; wherein each of the plurality of pentahedrons is sized to provide at least 1200 cubic feet of volume.

22. The modular structure of claim 4, wherein the modular structure for shipment is sized to be at most approximately 13'4" wide×12' tall×53'11" long.

23. The modular structure of claim 4, wherein the triangular frame comprises an equilateral triangular frame.

* * * * *